US012188480B2

(12) United States Patent
Tinapple

(10) Patent No.: US 12,188,480 B2
(45) Date of Patent: Jan. 7, 2025

(54) CEILING FAN ADAPTER ASSEMBLY

(71) Applicant: David E. Tinapple, London, OH (US)

(72) Inventor: David E. Tinapple, London, OH (US)

( * ) Notice: Subject to any disclaimer, the term of this patent is extended or adjusted under 35 U.S.C. 154(b) by 0 days.

(21) Appl. No.: 18/219,043

(22) Filed: Jul. 6, 2023

(65) Prior Publication Data

US 2024/0011503 A1 Jan. 11, 2024

Related U.S. Application Data

(60) Provisional application No. 63/358,715, filed on Jul. 6, 2022.

(51) Int. Cl.

| | |
|---|---|
| ***F04D 25/08*** | (2006.01) |
| ***F04D 29/54*** | (2006.01) |
| ***F04D 29/70*** | (2006.01) |

(52) U.S. Cl.

CPC ..... *F04D 25/088* (2013.01); *F04D 29/547* (2013.01); *F04D 29/703* (2013.01)

(58) Field of Classification Search

None

See application file for complete search history.

(56) References Cited

U.S. PATENT DOCUMENTS

| | | | |
|---|---|---|---|
| 2,221,703 | A | 11/1940 | Falco |
| 4,730,551 | A | 3/1988 | Peludat |
| 6,168,517 | B1 | 1/2001 | Cook |
| 6,551,185 | B1 | 4/2003 | Miyake |
| 6,955,596 | B1 | 10/2005 | Walker |
| D715,904 | S | 10/2014 | Tate et al. |
| 2010/0143112 | A1 | 6/2010 | Anchors |

*Primary Examiner* — Juan G Flores

(74) *Attorney, Agent, or Firm* — MIP Legal, Ltd.; Bryce D. Miracle, Esq.

(57) ABSTRACT

A ceiling fan adapter assembly for enhancing the airflow of a ceiling fan within a space. Generally, the ceiling fan adapter assembly includes a shroud; a directing grid attached to the shroud at a lower end thereof, the directing grid comprising a plurality of intersecting members to reduce cross-sectional flow area, creating a venturi effect; and a mounting assembly for supporting the shroud radially outward from the plurality of fan blades.

9 Claims, 23 Drawing Sheets

CEILING FAN ADAPTER ASSEMBLY

CROSS-REFERENCE TO RELATED APPLICATION

This application claims the benefit of U.S. provisional patent application entitled "PADDLE FAN ADAPTER ASSEMBLY" filed Jul. 6, 2022, having App. No. 63/358,715, the entire disclosure of which is hereby incorporated herein by reference.

BACKGROUND

Destratification is the reverse of the natural process of thermal stratification, which is the layering of differing (typically increasing) air temperatures from floor to ceiling. Stratification is caused by hot air rising up to the ceiling or roof space because it is lighter than the surrounding cooler air. Conversely, cool air falls to the floor as it is heavier than the surrounding warmer air.

In a stratified building, temperature differentials of up to 1.5° C. per vertical foot are common, and the higher a building's ceiling, the more extreme this temperature differential can be. In extreme cases, temperature differentials of 10° C. have been found over a height of 1 meter. Other variables that influence the level of thermal stratification include heat generated by people and processes present in the building, insulation of the space from outside weather conditions, solar gain, specification of the HVAC system, location of supply and return ducts, and vertical air movement inside the space, usually supplied by destratification fans.

In a study conducted by the Building Scientific Research Information Association, the wasted energy due to stratification increased consistently based on temperature differential from floor to ceiling ($\Delta T$). The study indicates that stratified buildings tend to overheat or overcool based on the temperature at the thermostat, which tends to be lower than the overall heat energy present in the room. The study also showed that energy waste due to stratification was present at ceiling heights ranging from 20 ft. to 40 ft, and higher ceilings caused higher energy waste, even at the same $\Delta T$. Since $\Delta T$ tends to be higher in taller ceilings, the effect of stratification is compounded, causing substantial energy waste in high-ceiling buildings.

Therefore, it would be highly advantageous to remedy the deficiencies inherent in the prior art. Accordingly, it is an object of the present invention to enhance a ceiling fan with sufficient vertical air movement to reduce an air temperature gradient within a room.

SUMMARY

In accordance with the invention, a ceiling fan adapter assembly is provided to improve the flow of air in a space by a ceiling fan having a plurality of fan blades. Generally, the ceiling fan adapter assembly includes a shroud; a directing grid attached to the shroud at a lower end thereof, the directing grid comprising a plurality of intersecting members to reduce cross-sectional flow area creating a venturi effect; and a mounting assembly for supporting the shroud radially outwardly from the plurality of fan blades.

In certain versions of the application, the ceiling fan adapter assembly comprises a plurality of connecting equal radial sections. Preferably, the plurality of connecting equal radial sections are radial quarter-sections.

In a version, the connecting equal radial sections form a wedge shape. Each radial section may comprise a partial shroud having a radial wall having an upper perimeter and a lower perimeter; a front point; a first and second radial perimeters extending radially outward from the front point; and at least one bracket vertically attached to a side of the radial wall for attachment to a reciprocal connecting radial section partial shroud; wherein the lower perimeter, first radial perimeter, and the second radial perimeter form an outer perimeter of the directing grid, wherein the upper perimeter provides a horizontal lip extending outward.

In certain versions of the application, a radial spacer ring assembly may be provided to assist airflow for smaller diameter fans as the air approaches the directing grid. Generally, the radial spacer ring assembly includes a radial wall and a plurality of radially outward extending tabs configured to attach to the upper lip of the shroud.

In some versions of the application, the radial spacer ring assembly is constructed of a plurality of connecting equal radial sections. Preferably, the plurality of radial interior sections are radial quarter-sections.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Figure 1:
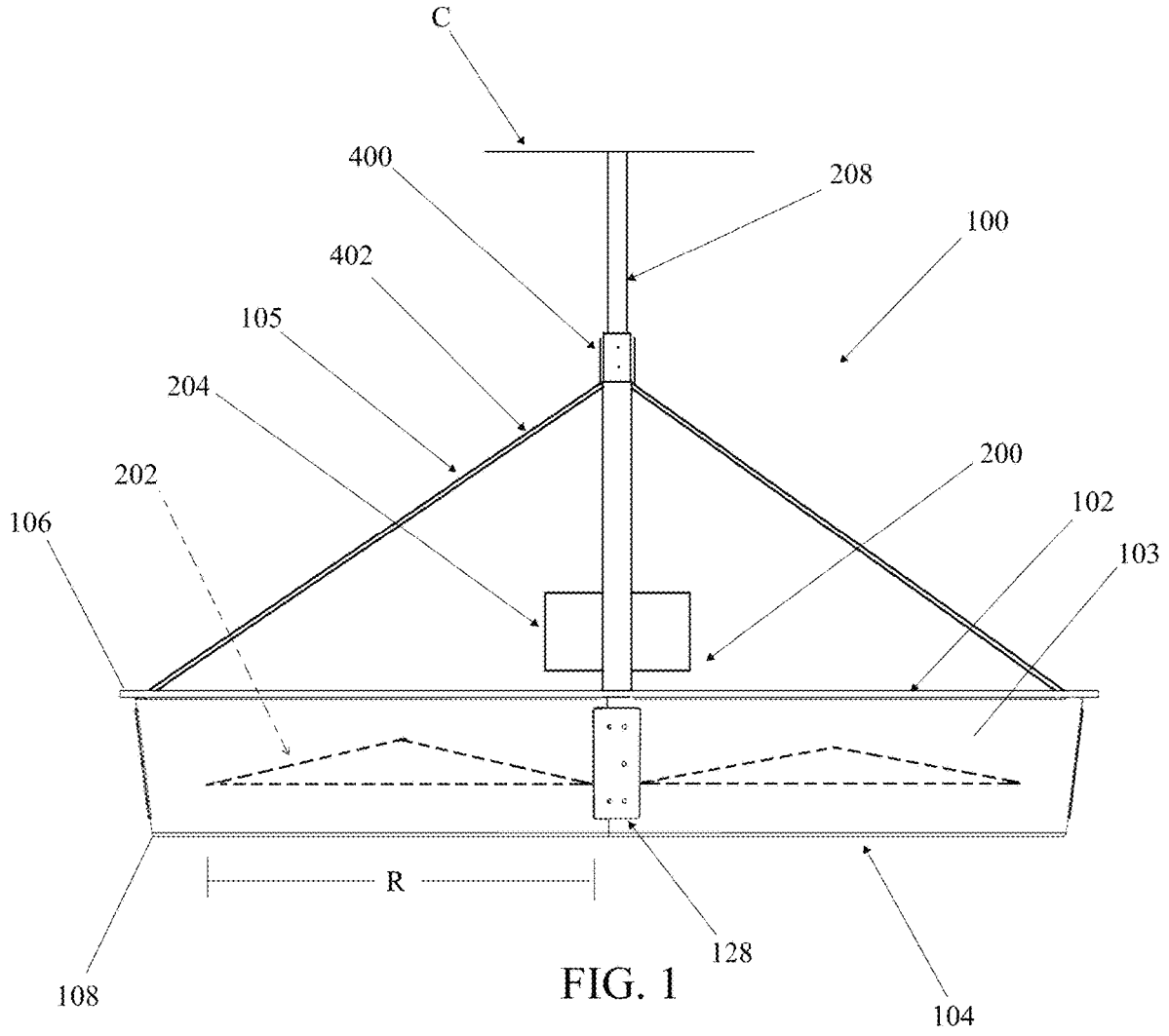
FIG. 1 is an elevation view of a version of the ceiling fan adapter shown while connected to a ceiling fan.

The following detailed description is of the best currently contemplated modes of carrying out exemplary versions of the invention. The description is not to be taken in a limiting sense but is made merely for the purpose of illustrating the general principles of the invention, since the scope of the invention is best defined by the appended claims.

Various inventive features are described below that can each be used independently of one another or in combination with other features.

Referring now to the figures wherein the showings are for purposes of illustrating a preferred version of the invention only and not for purposes of limiting the same, the present invention is a ceiling fan adapter assembly 100 for improving the flow of air in a space by a ceiling fan 200 having a plurality of blades 202 extending a radial distance R from a centerline thereof.

By way of operation, the ceiling fan adapter assembly 100 attaches securely below an existing industrial ceiling fan 200, preferably either 48" or 56" fans. The ceiling fan 200 moves room air through the tapered sides of the ceiling fan adapter assembly 100 and then through the directing grid 104, which adds velocity to the airflow. When the air reaches the floor, it spreads horizontally before rising again to the ceiling. This continuous cycling pulls the air from the highest ceiling space, mixes it with the air at the floor level, and eliminates temperature stratification. Testing has shown up to a 30% reduction in energy consumption while heating a building and a 20% reduction while cooling.

With reference to FIG. 1-FIG. 8, a general description of a version of the invention will be provided. Generally, a version of the ceiling fan adapter assembly 100 comprises a shroud 102 and a directing grid 104 attached to the shroud 102. The shroud 102 provides an upper perimeter 106, having a first diameter D1, and a lower perimeter 108, having a second D2. The directing grid 104 is preferably coupled at or near the lower perimeter 108. The directing grid 104 comprises a plurality of intersecting members to reduce cross-sectional flow area, thereby causing the rate of airflow to increase by way of the Venturi effect. Further, a mounting assembly 105 is provided to position the shroud 102 laterally about the ceiling fan 200 blades 202 and position the directing grid 104 below the blades 202, perpendicular to the flow of air.

With reference to FIG. 1, in a detailed version of the application, a ceiling fan 200 is shown comprising a plurality of blades 202, a motor 204, and a drive shaft providing rotation to the blades 202 from the motor 204. Further, a down rod 208 extends from the ceiling C to the motor 204, and blades 202 serve the purpose of suspending the ceiling fan 200 away from the ceiling C and providing a conduit through which the electrical supply is communicated.

Figure 6:
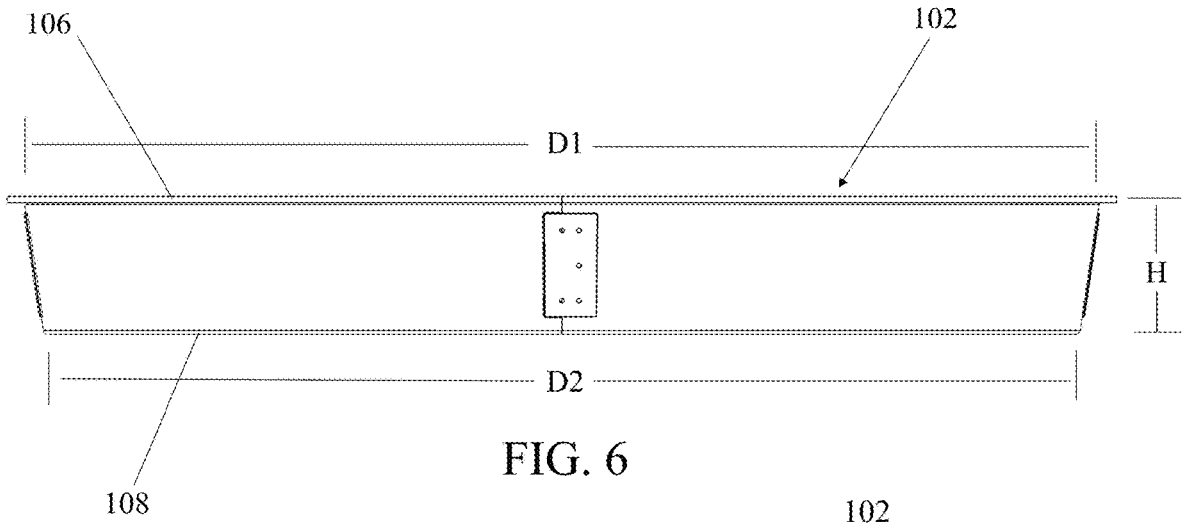
FIG. 6 is a first side elevation view of the shroud and directing grid of the version shown in FIG. 1.
Figure 7:
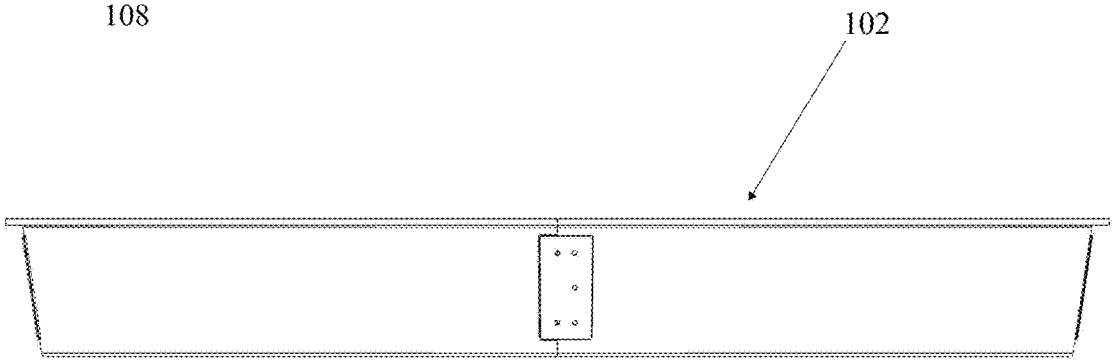
FIG. 7 is a second side elevation view of the shroud and directing grid of the version shown in FIG. 1.
Figure 8:
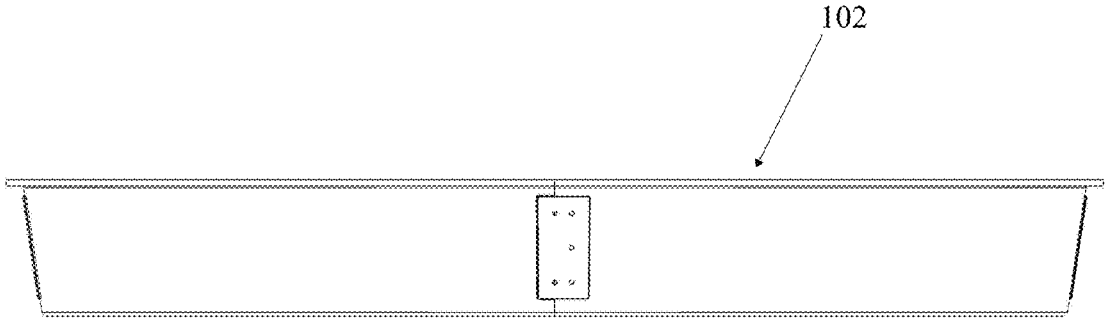
FIG. 8 is a third side elevation view of the shroud and directing grid of the version shown in FIG. 1.

FIG. 6-FIG. 8 are elevation side views of the shroud 102. In the exemplary embodiment, the shroud 102 is positioned around, and laterally adjacent to, the blades 202. In some versions of the invention, the shroud 102 is cylindrical having a vertical wall that has an upper perimeter 106, having an equal diameter 108, each having equal diameters D1, D2. In the preferred illustrated version, however, the upper perimeter 106, diameter D1 is greater in diameter than the lower perimeter 108, diameter D2, forming a cone or frustoconical radial wall 103 that causes an increase in the speed of the airflow from the ceiling fan 200 to the directing grid 104 by reducing the cross-sectional area. Naturally, the first and second diameters D1 and D2 will be greater than the diameter of the existing ceiling fan 200 blades 202. Preferably, D1 is at least 50 inches, more preferably 51.5 inches, and D2 is at least 55 inches, more preferably 56.25 inches. Preferably, the height H of the shroud 102 is at least 5 inches, preferably 8 inches. Preferably, the outward angle T formed between the frustoconical radial wall 103 and the plane of the directing grid is between 75 degrees and 85 degrees, more preferably between 79 degrees to 82 degrees (See FIG. 29).

Figure 29:
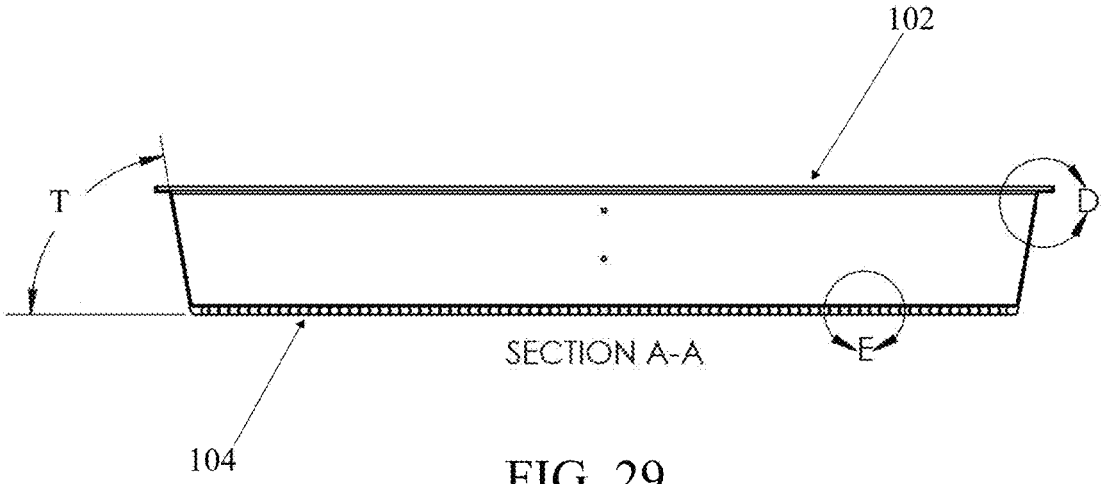
FIG. 29 is a side elevation view of the version of the ceiling fan adapter shown in FIG. 25.
Figure 30:
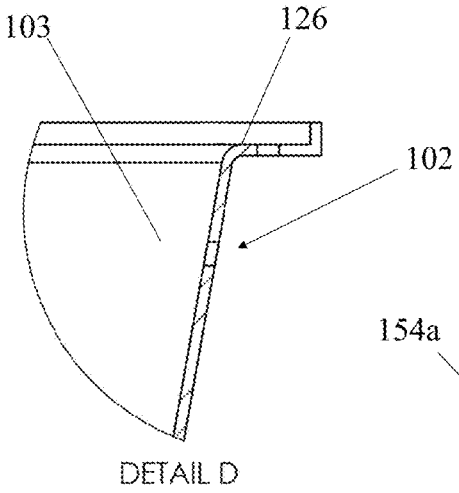
FIG. 30 is a detail view taken from detail D of FIG. 29.
Figure 31:
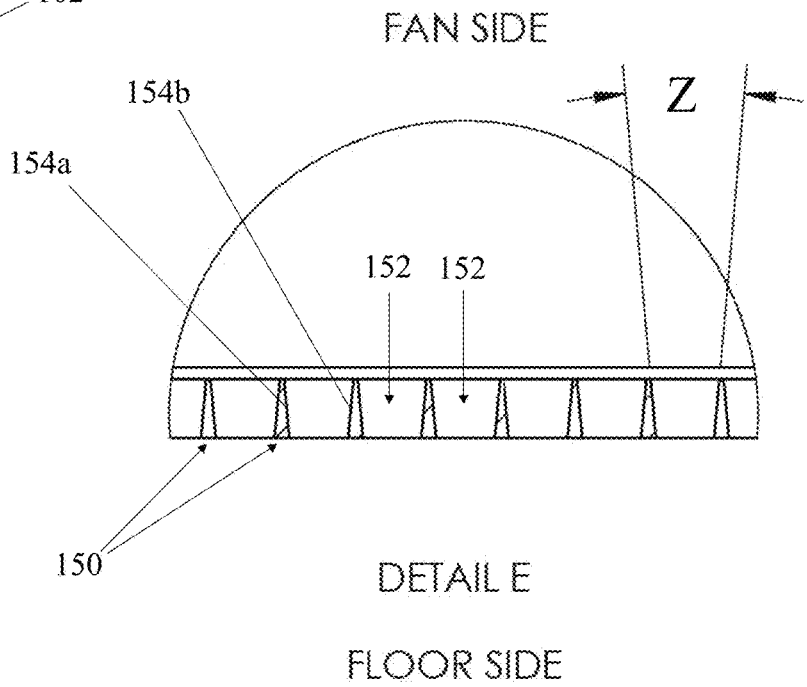
FIG. 31 is a detail view taken from detail E of FIG. 29.
Figure 32:
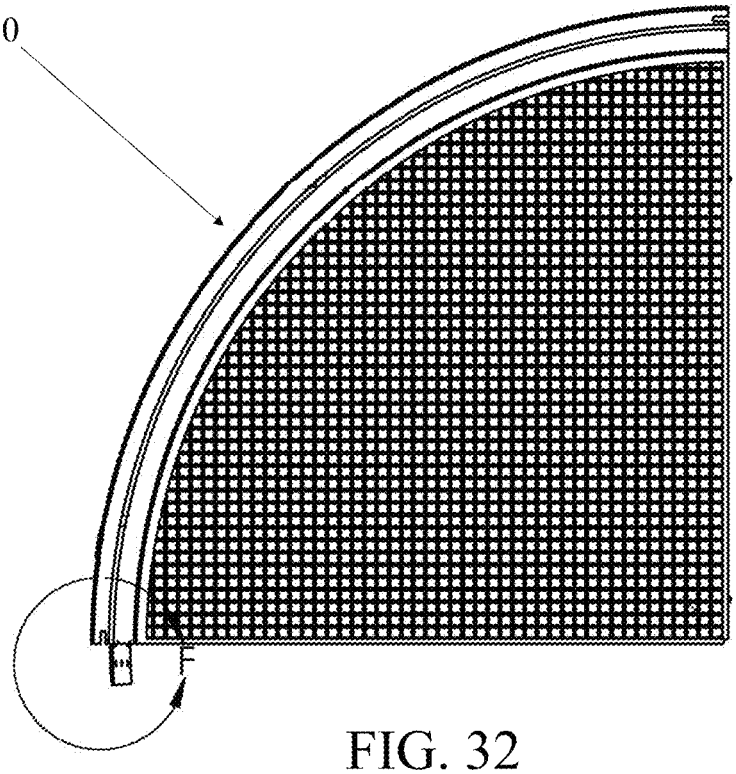
FIG. 32 is a top plan view of a version of the radial quarter-section of the ceiling fan assembly.
Figure 33:
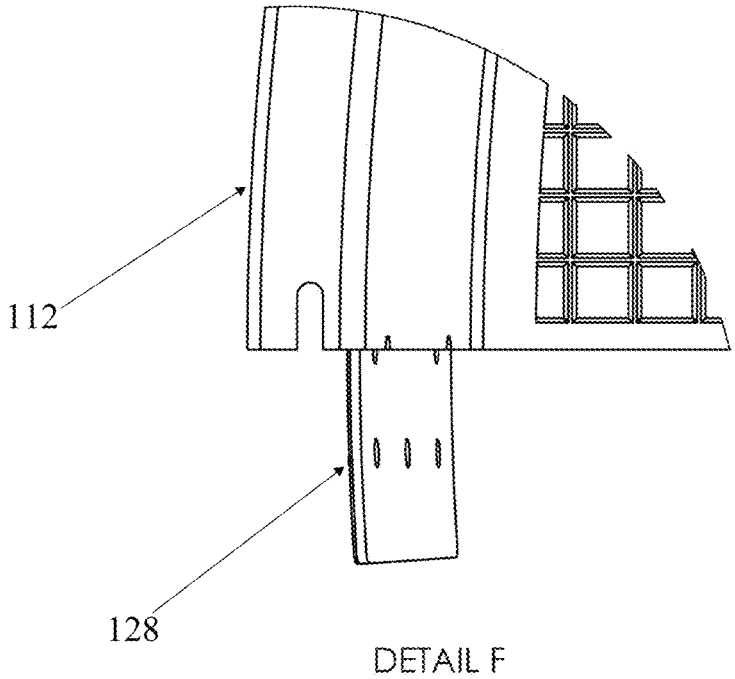
FIG. 33 is a detail view taken from detail F of FIG. 32.

With reference to FIG. 29-FIG. 31, the directing grid 104 is constructed of a plurality of intersecting members 150 along a horizontal plane. The plurality of intersecting members 150 form a plurality of channels 152 that narrow in cross-sectional area from a fan side (upstream) to a floor side (downstream). Preferably, the plurality of channels 152 have a rectangular cross-section formed between at least two opposing walls 154*a*, 154*b*. In certain versions, the angle Z formed between the first and second wall is preferably between 8-12 degrees, most preferably 10 degrees (See FIG. 31).

As best shown in FIG. 9-FIG. 15, the ceiling fan adapter assembly 100 may be constructed of a plurality of connecting equal radial sections 110. Preferably, as shown, four equal radial quarter-sections 110 are provided. Each radial quarter-section 110 forms a wedge shape and is configured to connect and interlock with an adjacent radial quarter-section 110 in order to completely encompass an existing ceiling fan 200. Generally, each radial quarter-section 110 comprises a partial shroud 112 with an upper perimeter 114 and a lower perimeter 116 and a directing grid section 118 forming a wedge. The directing grid section 118 comprises a front point 120 and a first and second radial perimeters 122, 124 extending radially outward from the front point 120 to the opposing ends of the partial shroud 112.

In the illustrated version, the upper perimeter 114 of each partial shroud 112 incorporates a horizontal lip 126 extending outward, providing a mounting assembly 115 connection surface.

Figure 2:
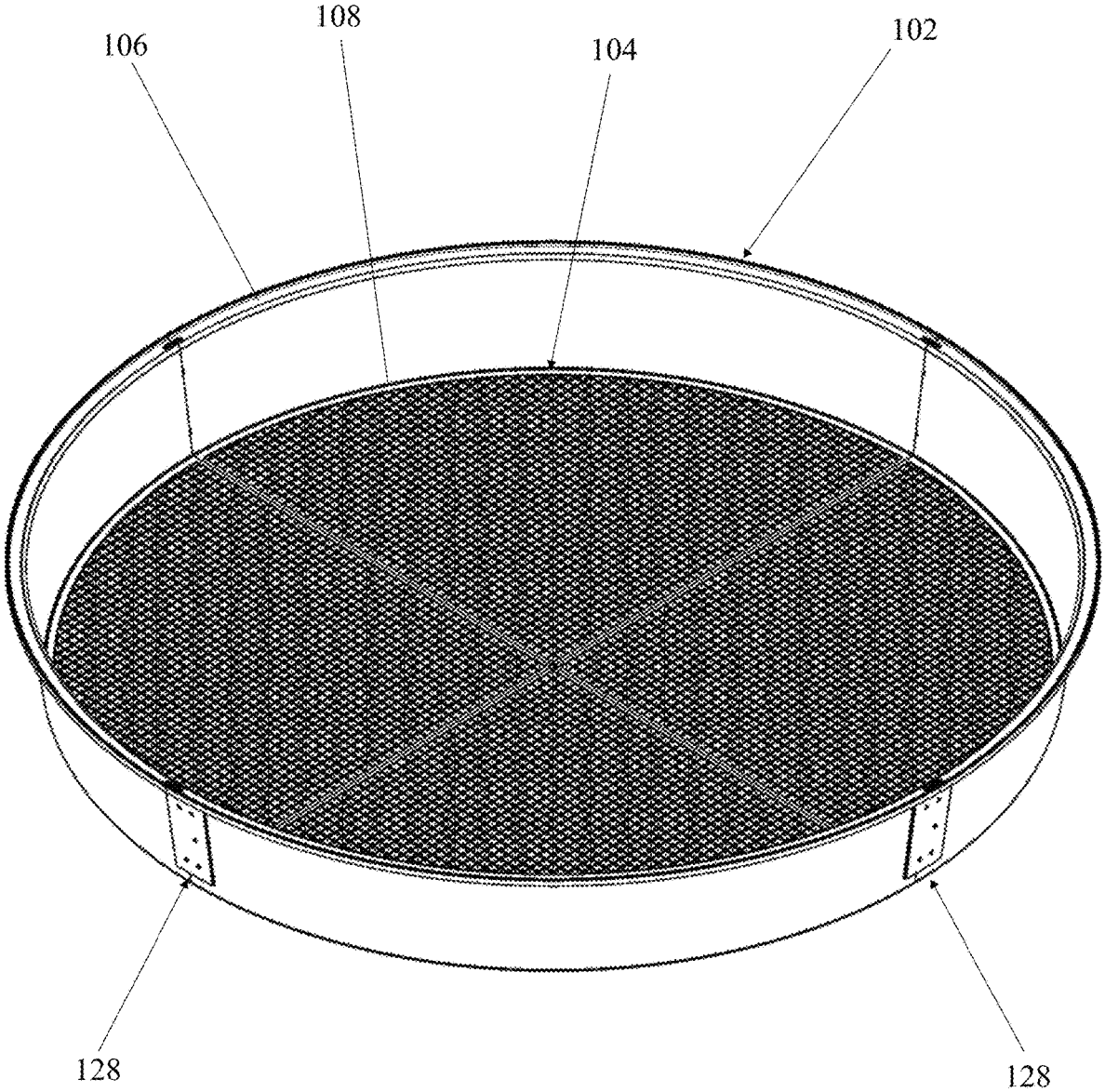
FIG. 2 is a side perspective view of the shroud and directing grid of the version shown in FIG. 1.
Figure 3:
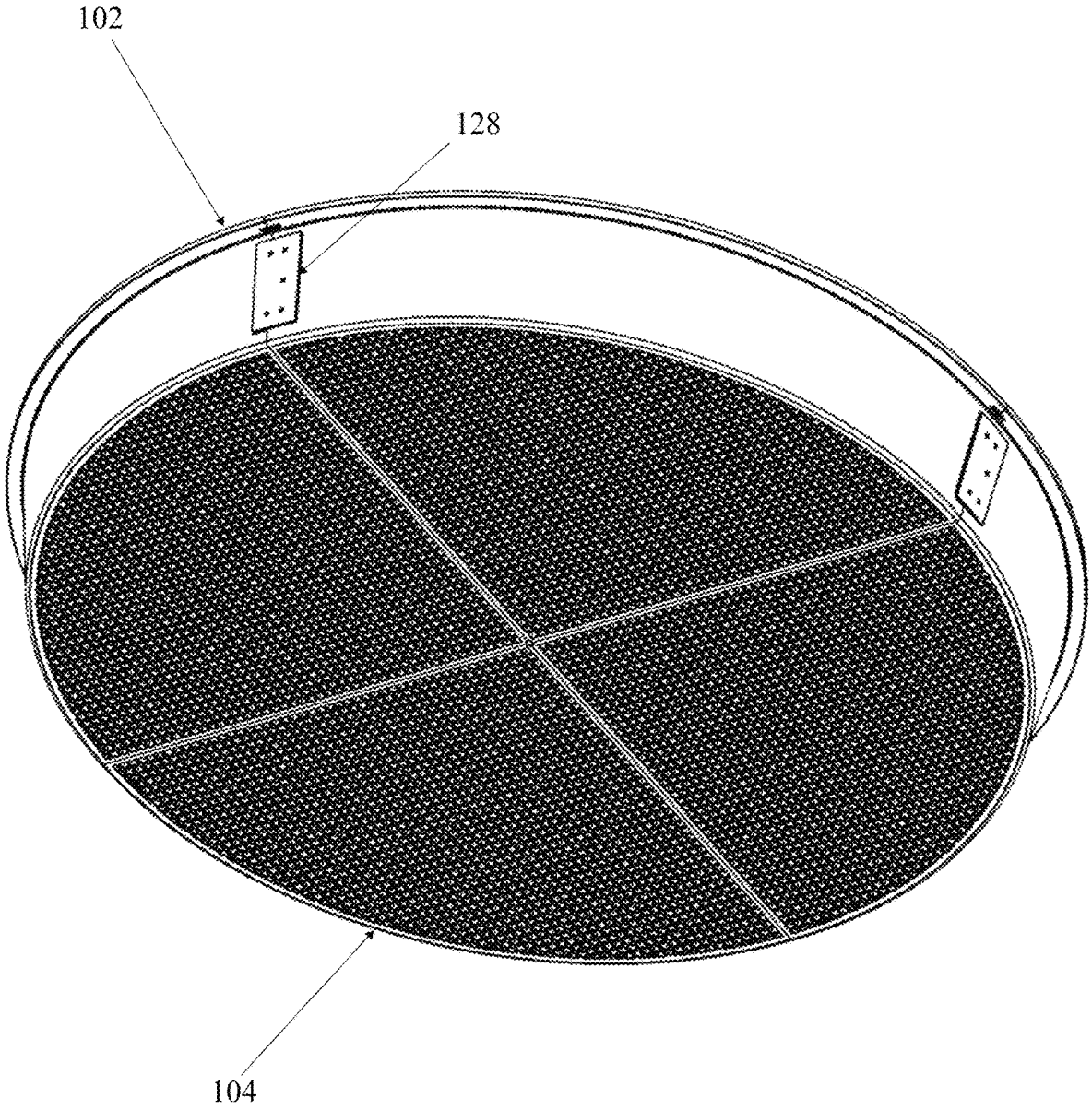
FIG. 3 is a bottom perspective view of the shroud and directing grid of the version shown in FIG. 1.
Figure 4:
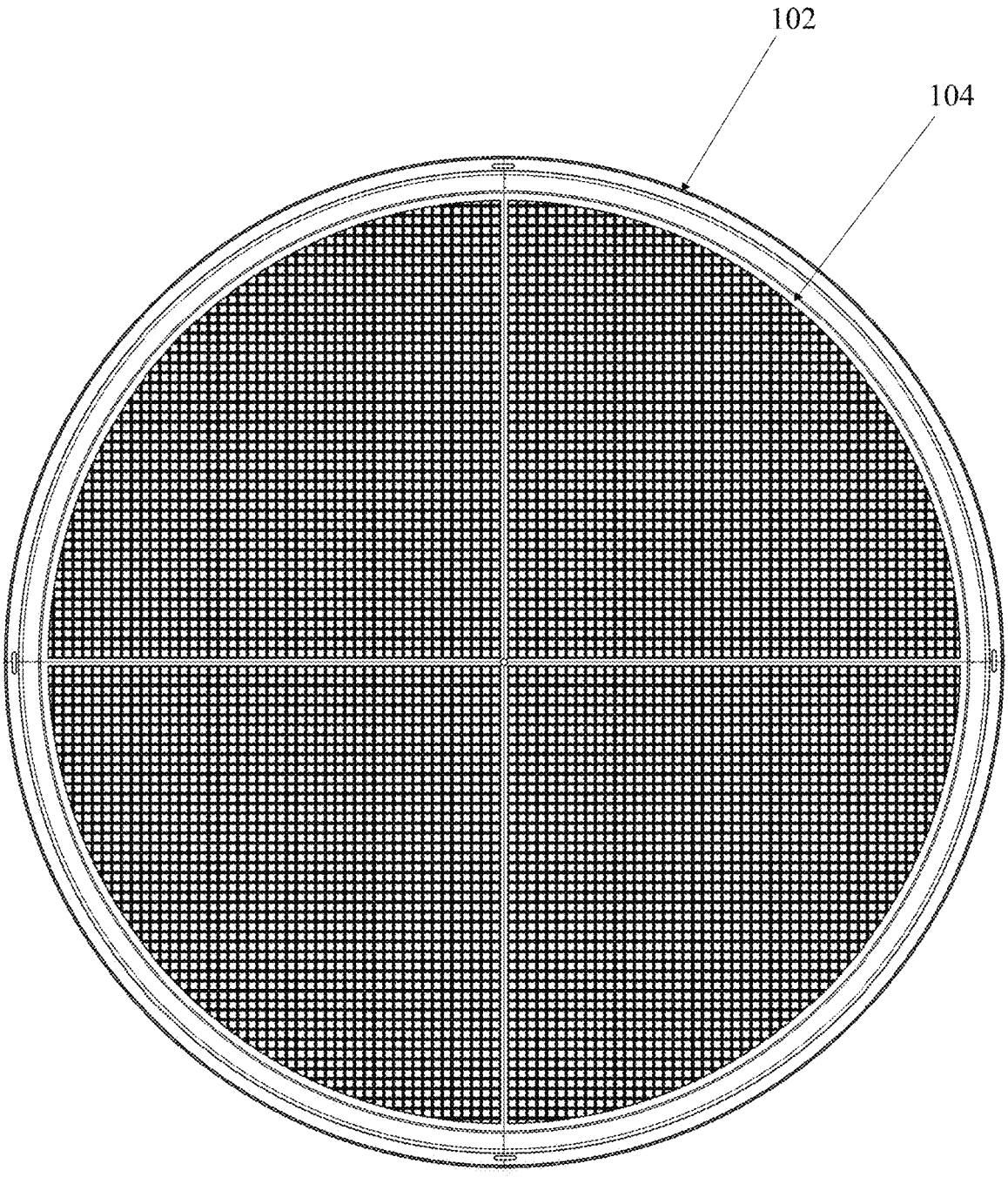
FIG. 4 is a top plan view of the shroud and directing grid of the version shown in FIG. 1.
Figure 5:
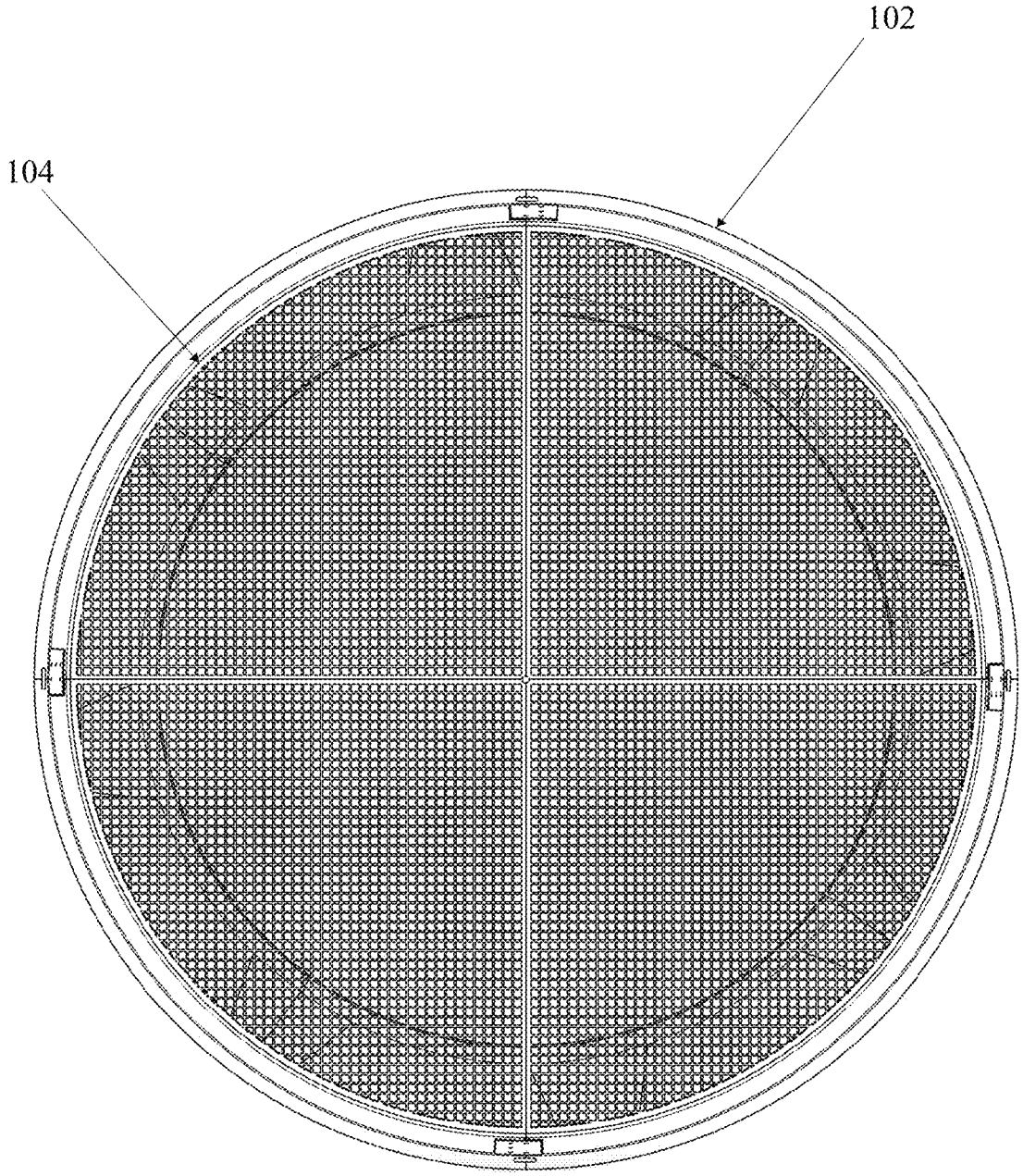
FIG. 5 is a bottom plan view of the shroud and directing grid of the version shown in FIG. 1.
Figure 9:
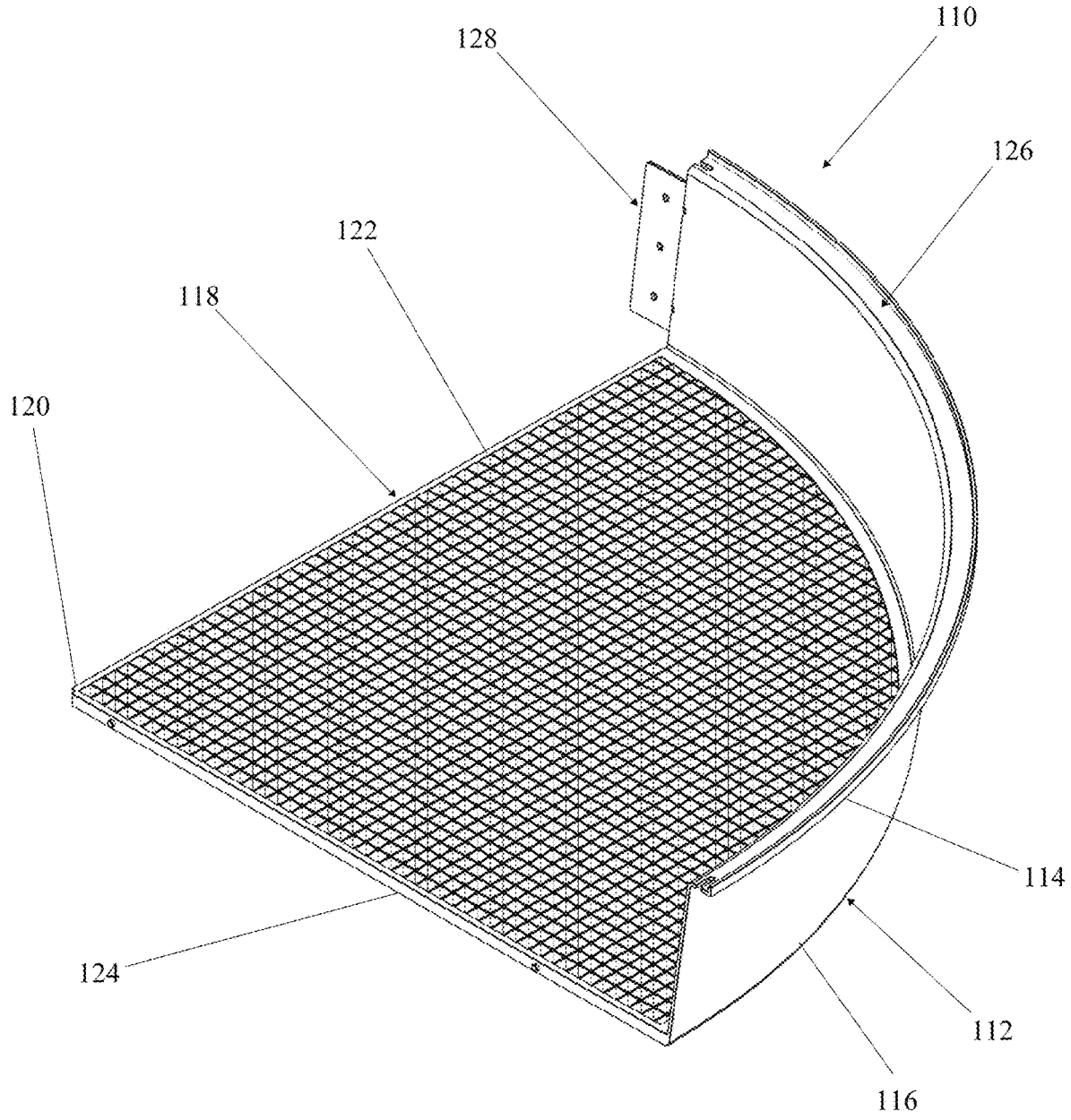
FIG. 9 is a side perspective view of the radial quarter-section of the ceiling fan adapter.
Figure 10:
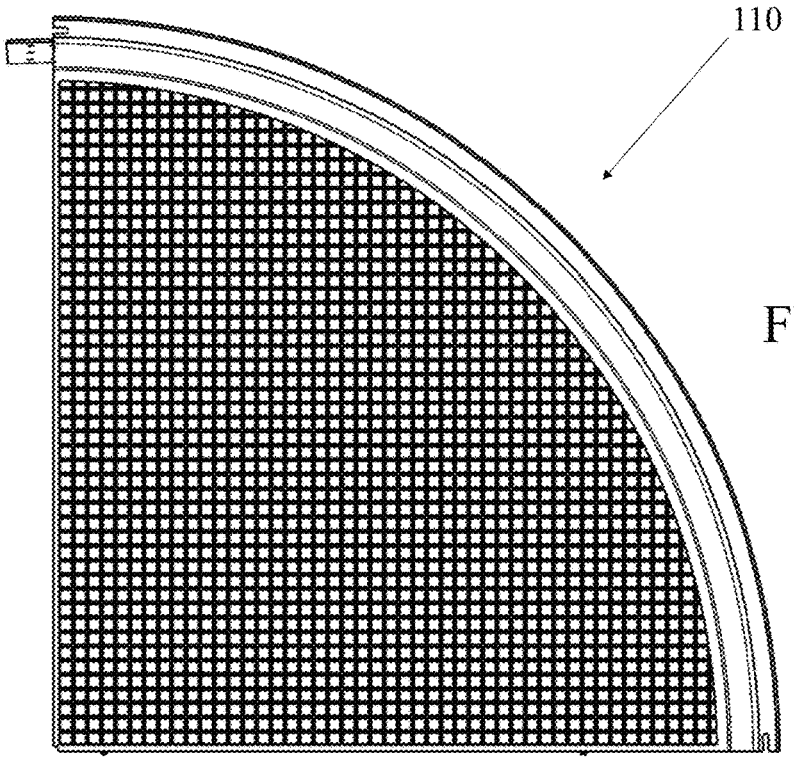
FIG. 10 is a top plan view of the radial quarter-section of the ceiling fan adapter shown in FIG. 9.
Figure 11:
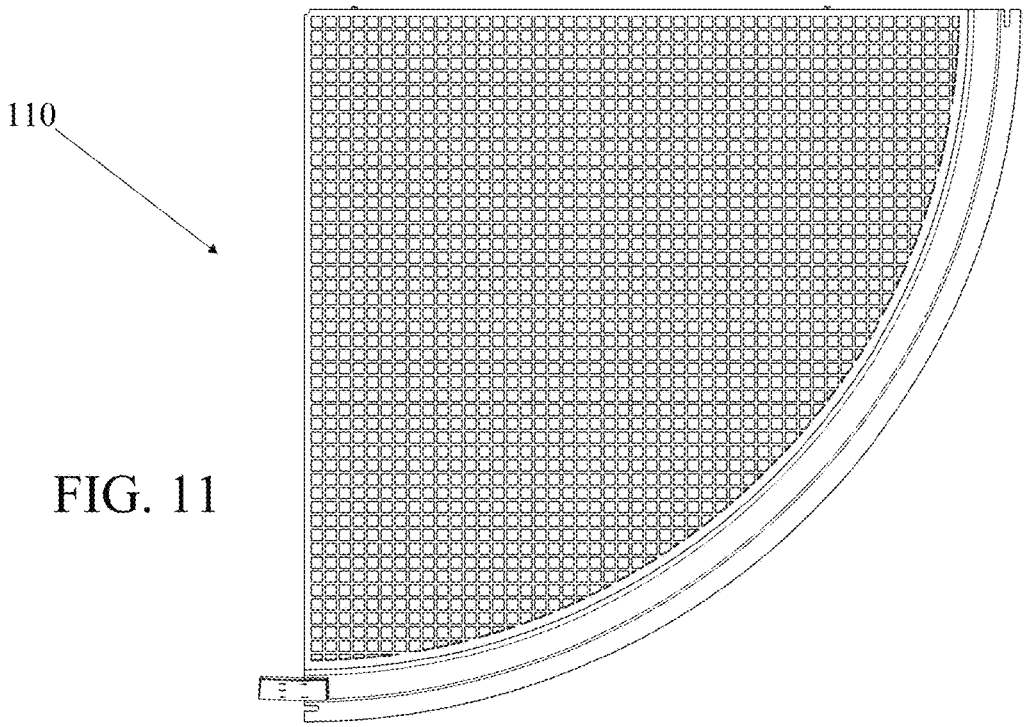
FIG. 11 is a bottom plan view of the radial quarter-section of the ceiling fan adapter shown in FIG. 9.
Figure 12:
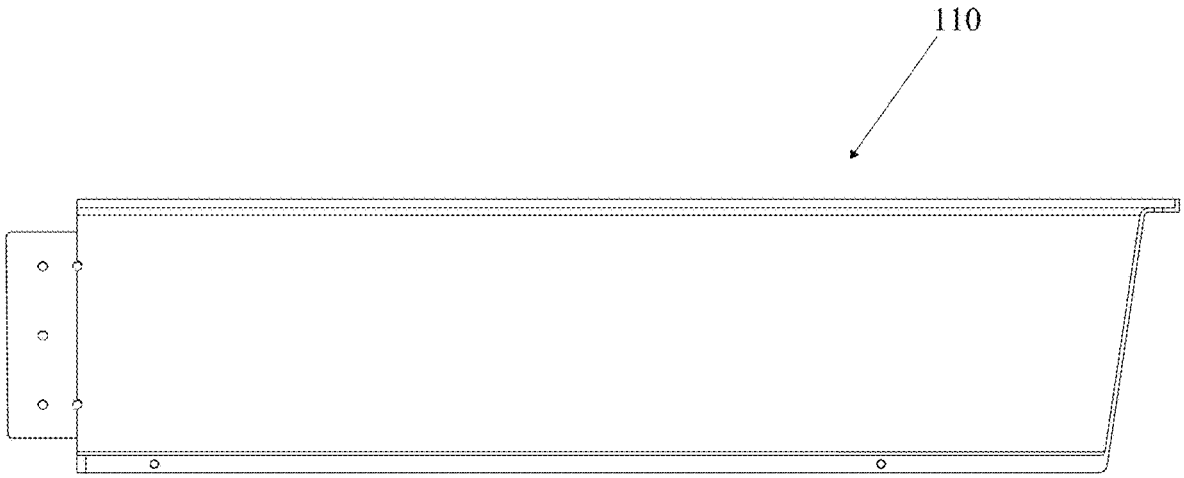
FIG. 12 is an interior elevation view of the radial quarter-section of the ceiling fan adapter shown in FIG. 9.
Figure 13:
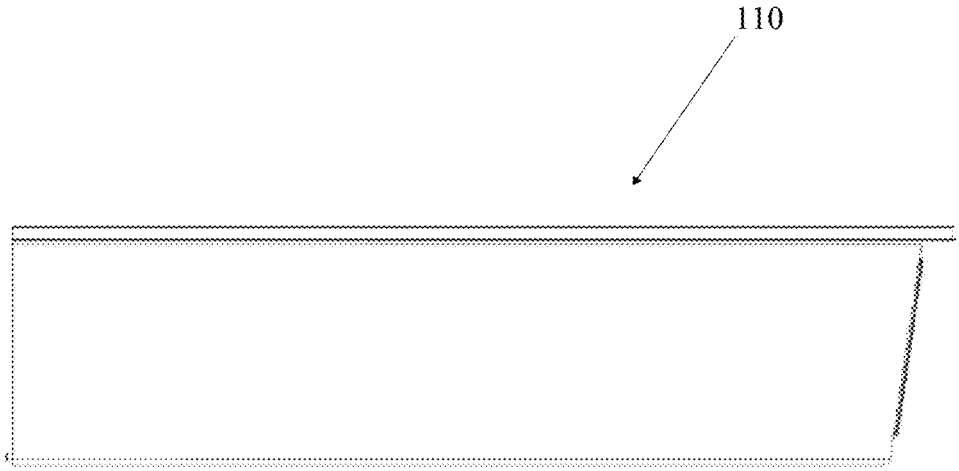
FIG. 13 is a side elevation view of the radial quarter-section of the ceiling fan adapter shown in FIG. 9.
Figure 14:
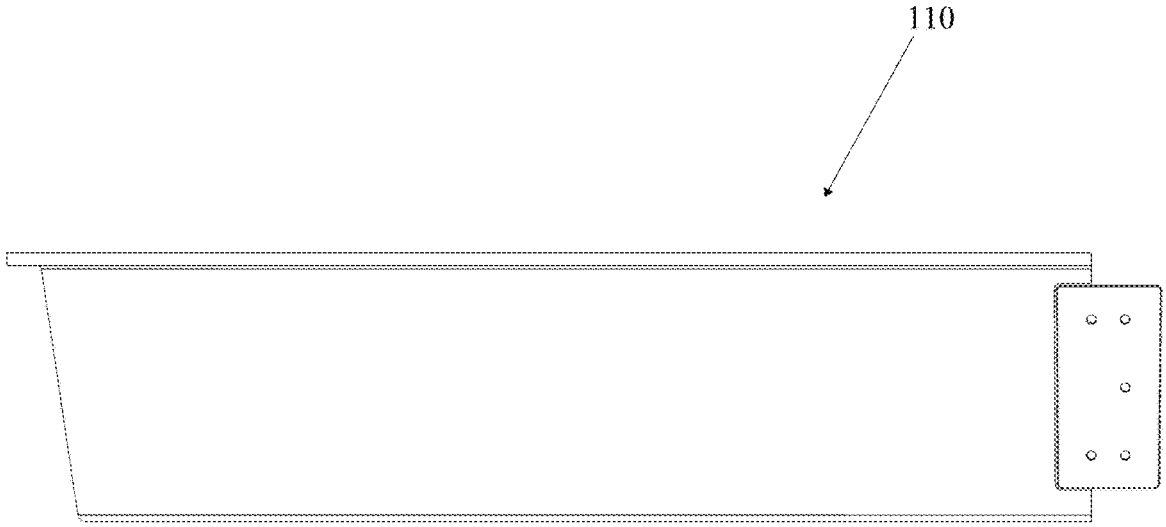
FIG. 14 is an exterior side elevation view of the radial quarter-section of the ceiling fan adapter shown in FIG. 9.
Figure 15:
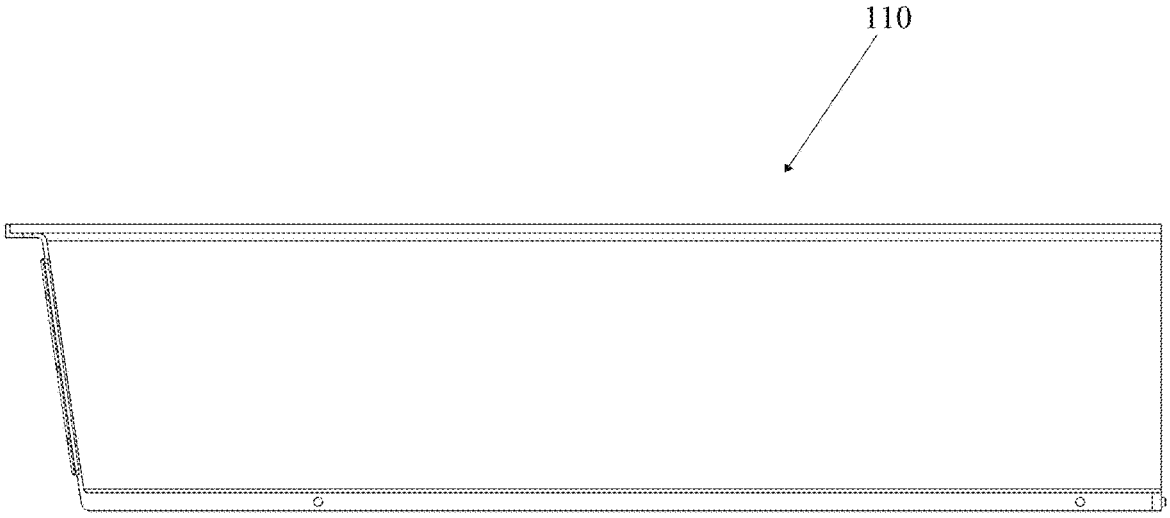
FIG. 15 is an interior elevation view of the radial quarter-section of the ceiling fan adapter shown in FIG. 9.
Figure 16:
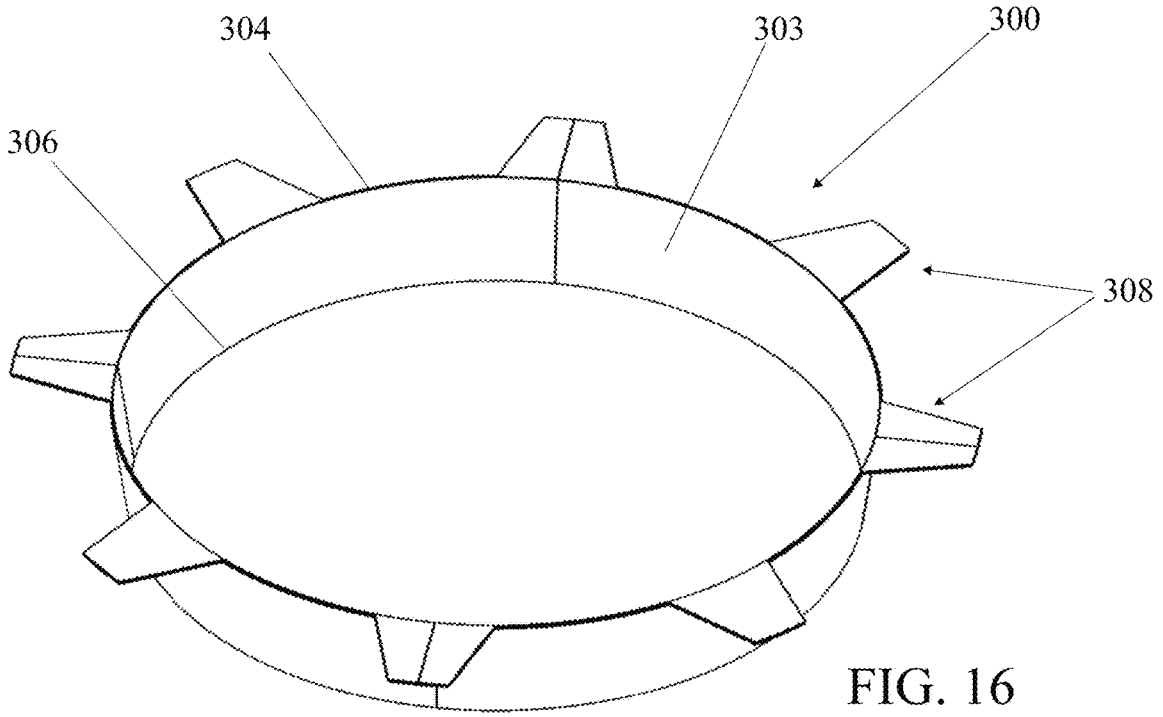
FIG. 16 is a top perspective view of a version of a radial spacer ring assembly.
Figure 17:
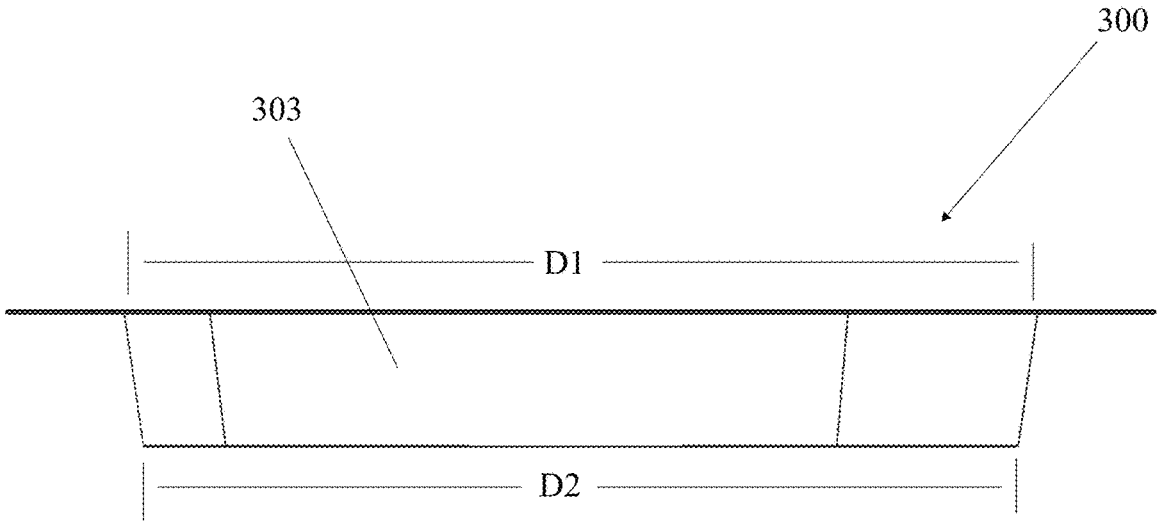
FIG. 17 is an elevation view of the radial spacer ring assembly shown in FIG. 16.
Figure 18:
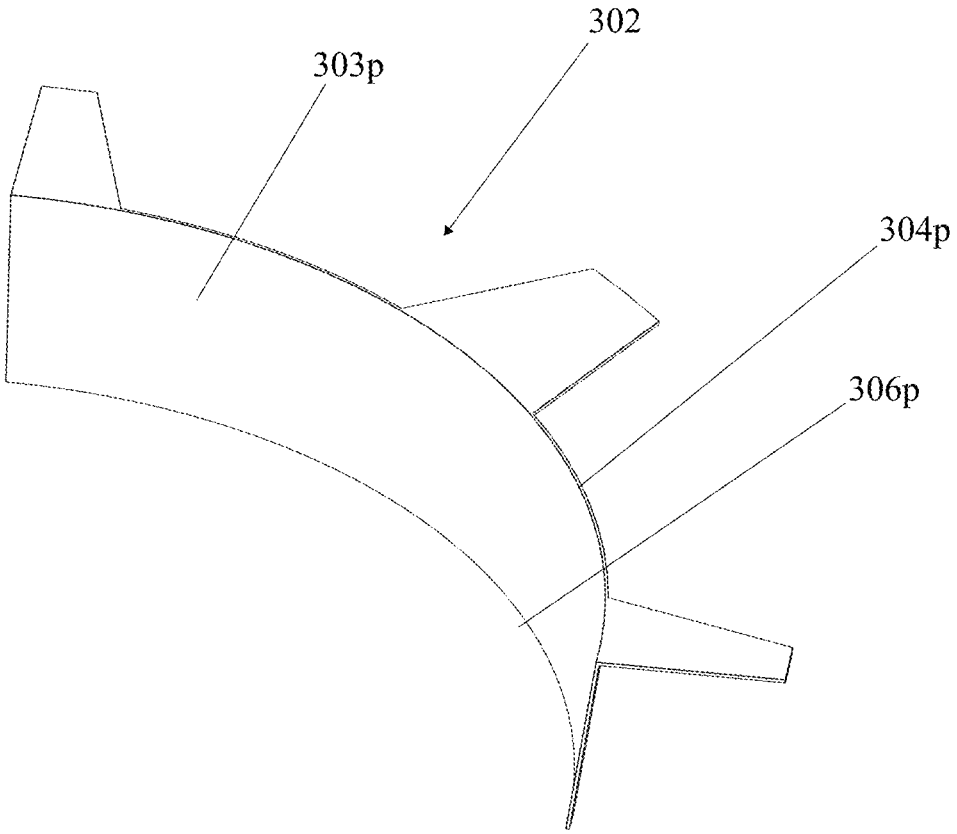
FIG. 18 is a perspective view of a radial section of the radial spacer ring assembly shown in FIG. 16.
Figure 19:
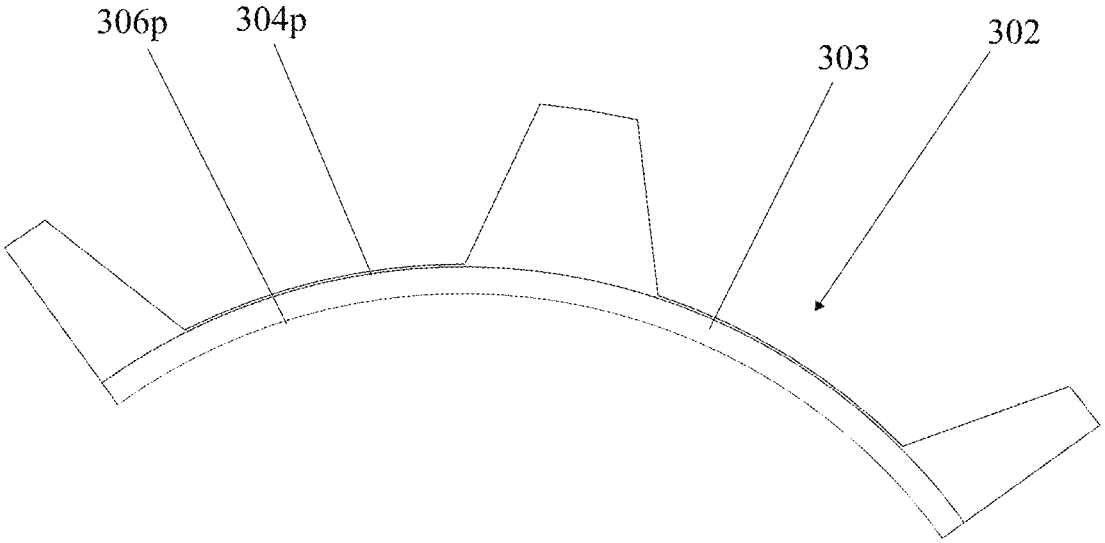
FIG. 19 is a top plan view of a radial section of the radial spacer ring assembly shown in FIG. 16.
Figure 20:
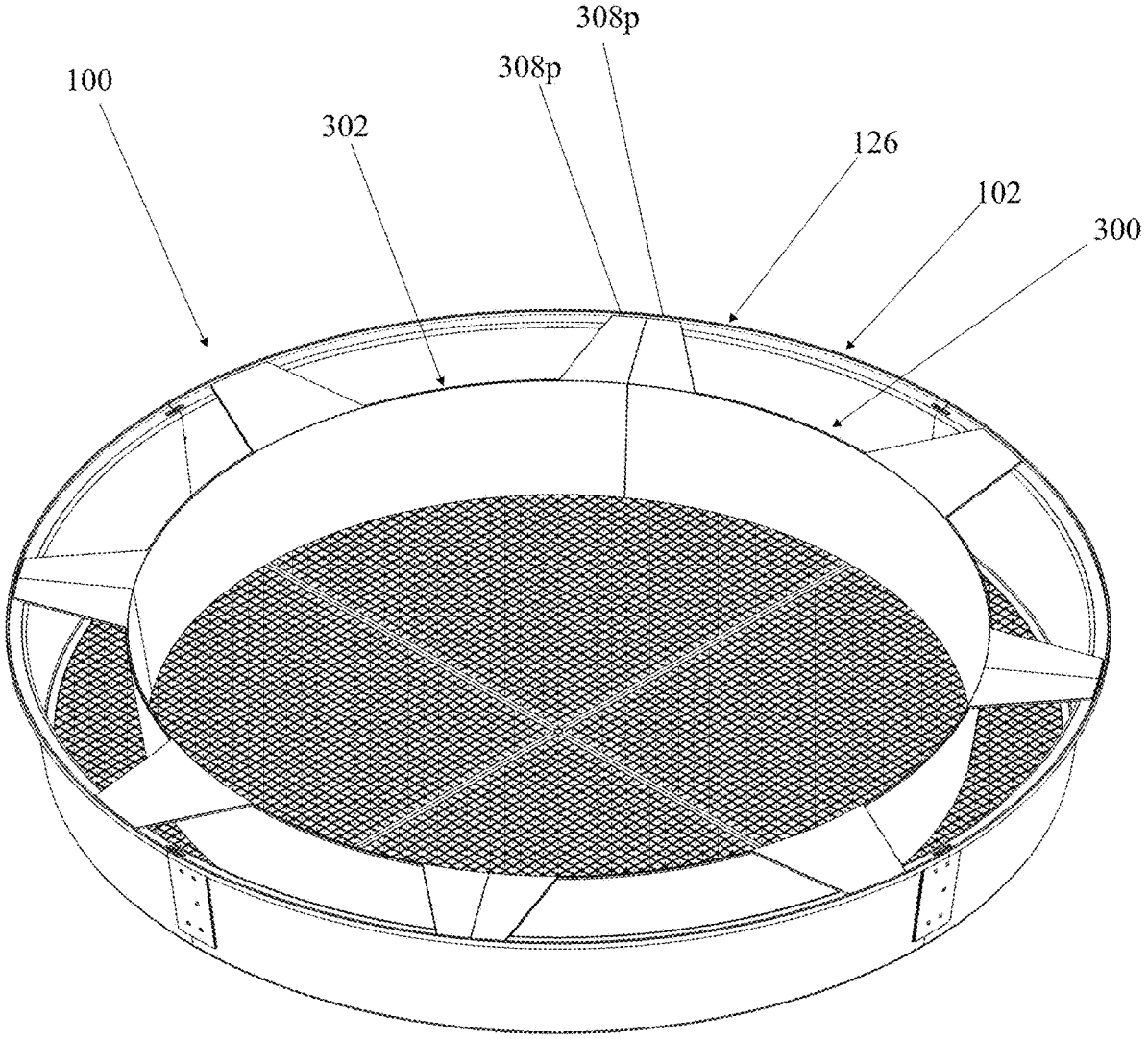
FIG. 20 is a side perspective view of a version of the ceiling fan adapter having a radial spacer ring assembly.
Figure 34:
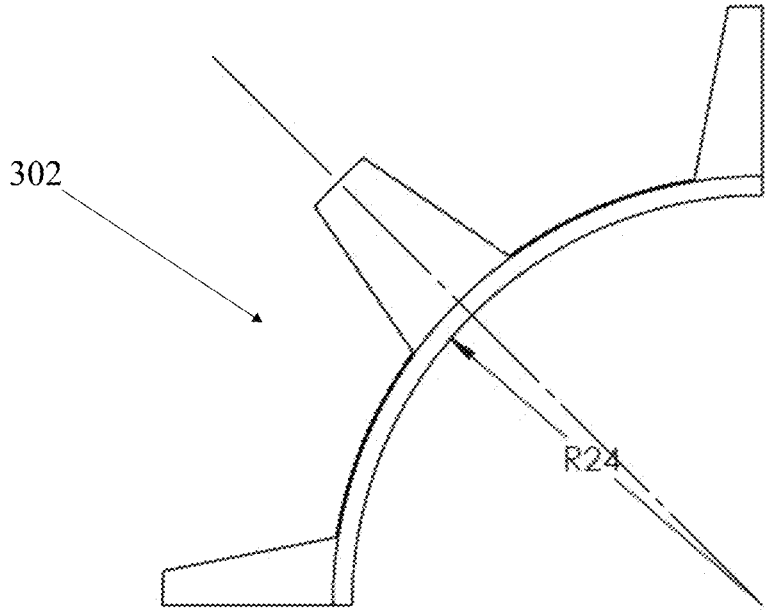
FIG. 34 is a top plan view of a version of the radial quarter-section of the radial spacer ring assembly.

As best illustrated in FIG. 9 and FIG. 34, in certain versions of the application, at least one bracket 128 is utilized to connect adjacent radial quarter-sections 110 by way of adjacent partial shrouds 112. As shown in FIG. 2, in a version, four brackets 128 are utilized to assemble all four radial quarter-sections 110 to form the complete ceiling fan adapter assembly 100.

In certain versions of the application, as shown in FIG. 16-FIG. 24, the ceiling fan adapter assembly 100 further includes a radial spacer ring assembly 300 that is positioned interior of the radial shroud 102. The radial spacer ring assembly 300 generally assists airflow direction and velocity from the ceiling fan 200 to the directing grid 104 for a reduced sized ceiling fan 200, for example, a 48" diameter ceiling fan assembly.

Generally, the radial spacer ring assembly 300 comprises a radial wall 303 with an upper perimeter 304 having a first diameter D1 and a lower perimeter 306 having a second diameter D2. Preferably, the upper perimeter 304 first diameter is larger than the lower perimeter 306 second diameter D2 forming a frustoconical shape to increase the velocity of the airflow from the ceiling fan 200 blades 202 to the directing grid 104 (See FIG. 17). However, other versions may provide a vertical radial wall or a curved radial wall.

Figure 35:
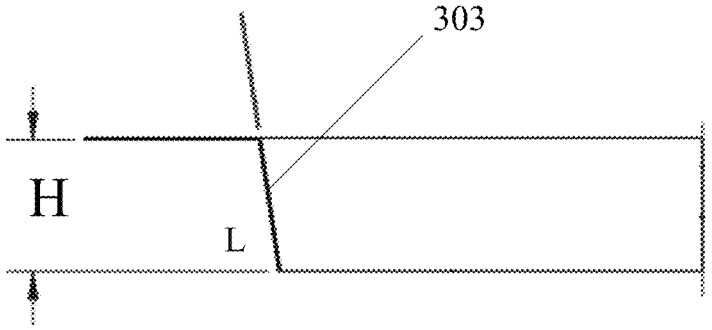
FIG. 35 is a side elevation view of the radial quarter-section of the radial spacer ring assembly.

Preferably, the outward angle L formed between the radial wall 303 and the plane of the directing grid 104 is between 75 degrees and 85 degrees, more preferably between 79 degrees and 82 degrees (See FIG. 35). In certain versions, the outward angle T of the shroud 102 is equal to the outward angle L of the radial spacer ring assembly 300. Preferably, the height H of the radial wall is at least 5 inches, preferably 7.25 inches.

Further, the radial spacer ring assembly 300 may include a plurality of radially outward extending tabs 308 configured to attach to the horizontal lip 126 of the shroud 102. These tabs 308 centrally support the radial spacer ring assembly 300 to and within the ceiling fan adapter assembly 100.

As best shown in FIG. 18-FIG. 22, the radial spacer ring assembly 300 is provided in a plurality of connecting equal radial sections 302. Preferably, as shown, four equal radial quarter-sections 302 are provided. Each radial quarter-section 302 forms a semi-circular shape and is configured to connect and interlock with an adjacent radial quarter-section 302 in order to completely encompass an existing ceiling fan 200. Generally, each radial quarter-section 302 comprises a partial radial wall 303*p* having an upper perimeter 304*p* and a lower perimeter 306*p*.

Figure 22:
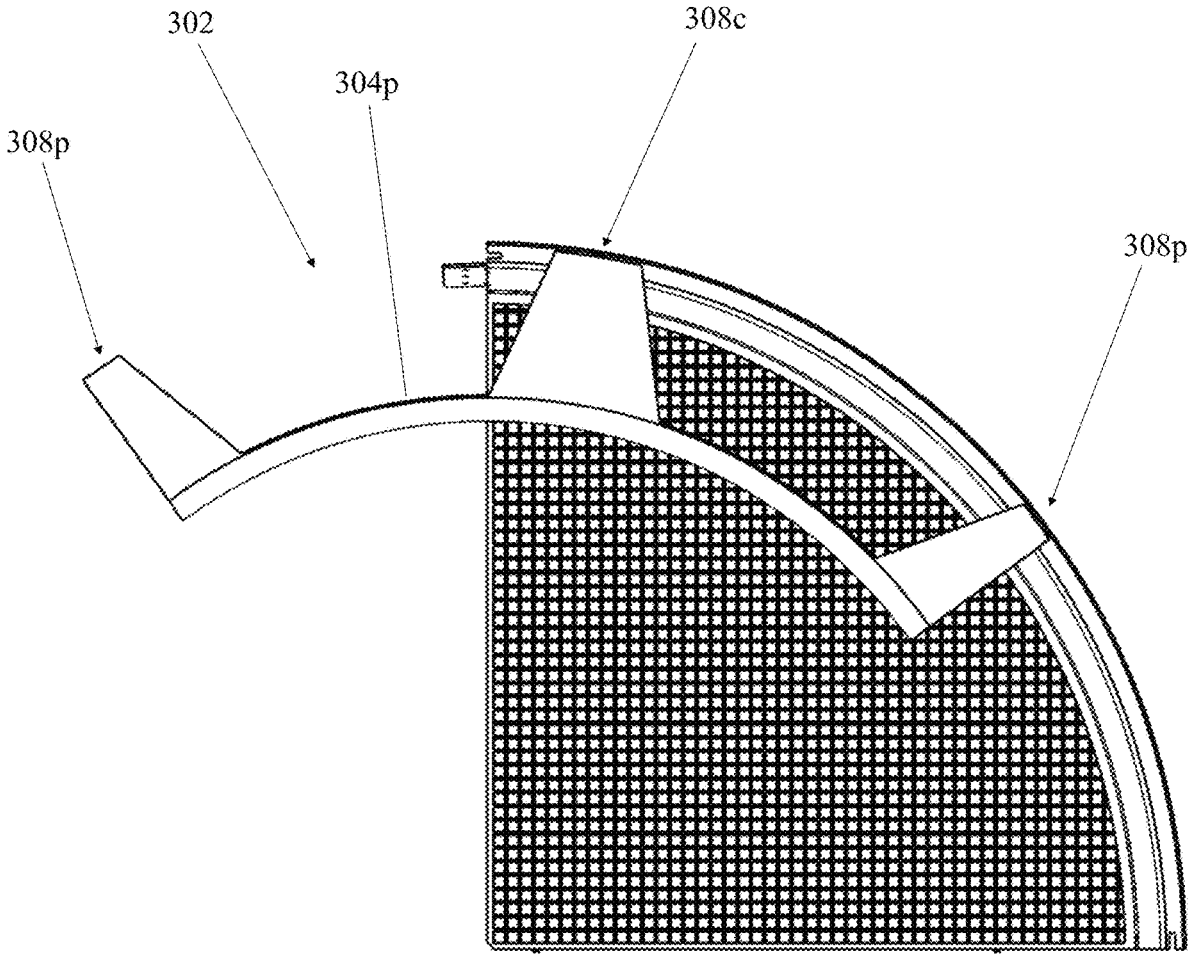
FIG. 22 is a top plan view of a radial section of a radial spacer ring assembly attached to a section of the shroud and directing grid.
Figure 23:
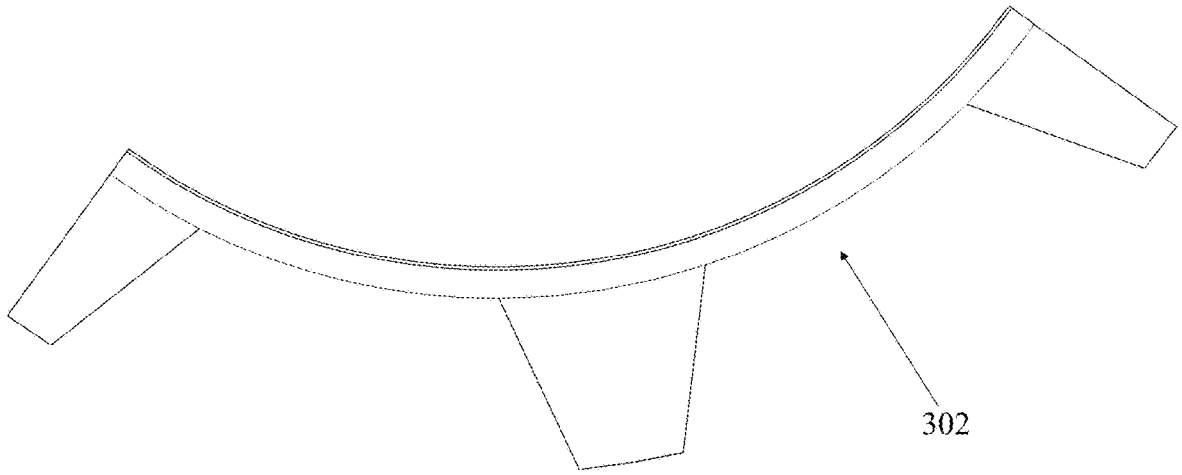
FIG. 23 is a bottom plan view of a radial section of the radial spacer ring assembly shown in FIG. 16.
Figure 24:
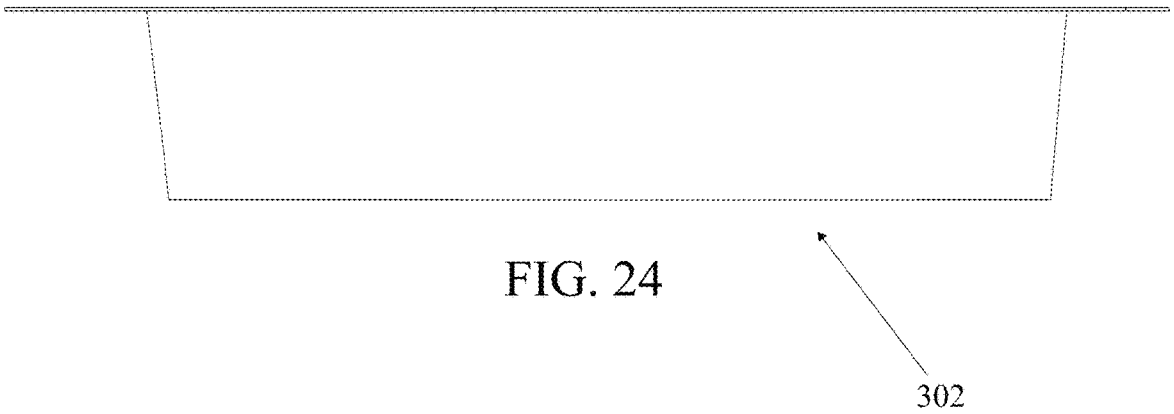
FIG. 24 is a side elevation view of a radial section of the radial spacer ring assembly shown in FIG. 16.
Figure 25:
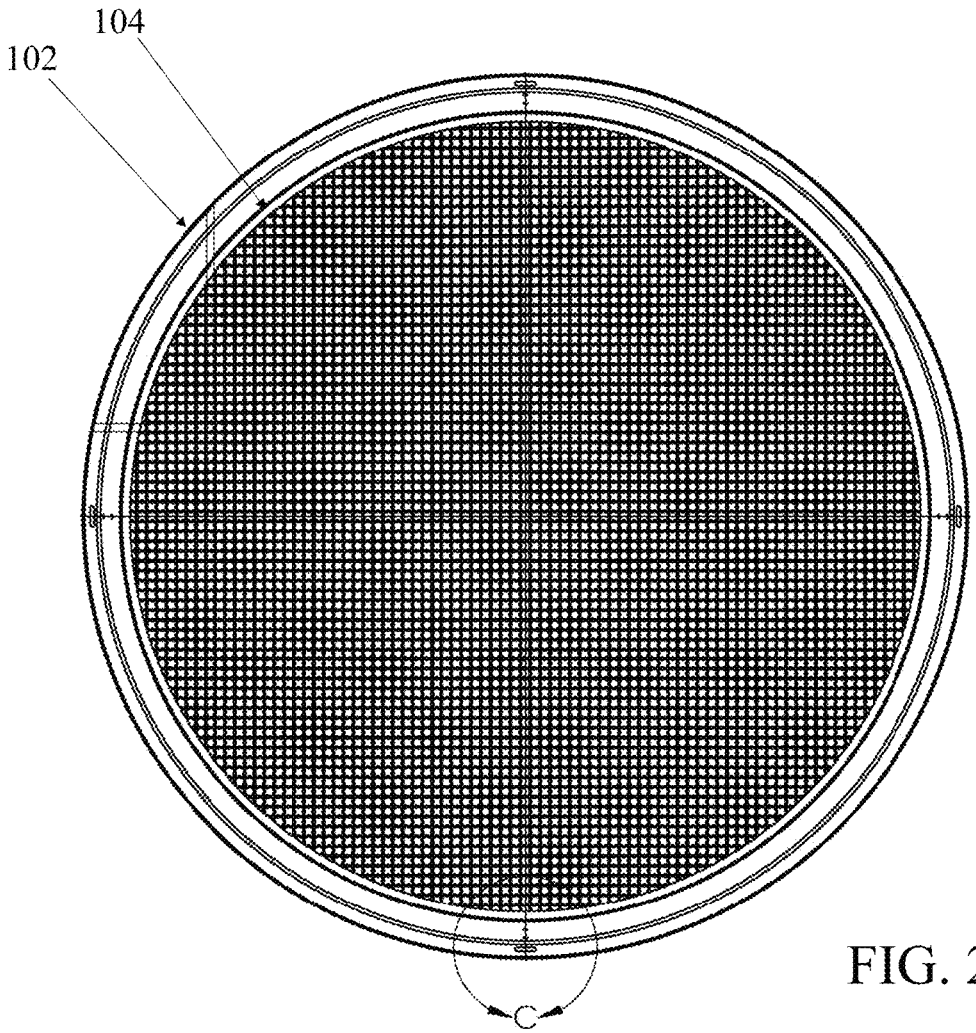
FIG. 25 is a top plan view of the version of the ceiling fan adapter.
Figure 26:
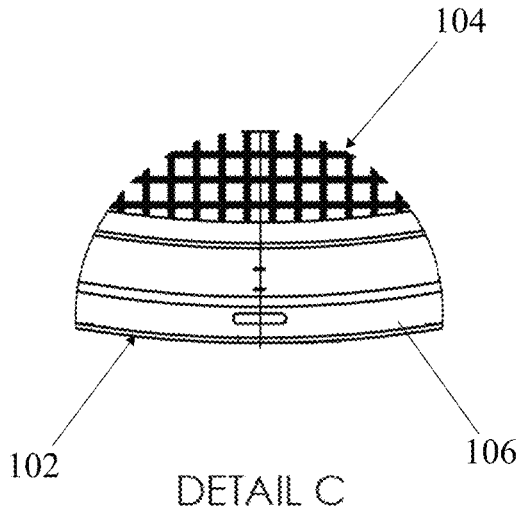
FIG. 26 is a detail view taken from detail C of FIG. 25.
Figure 27:
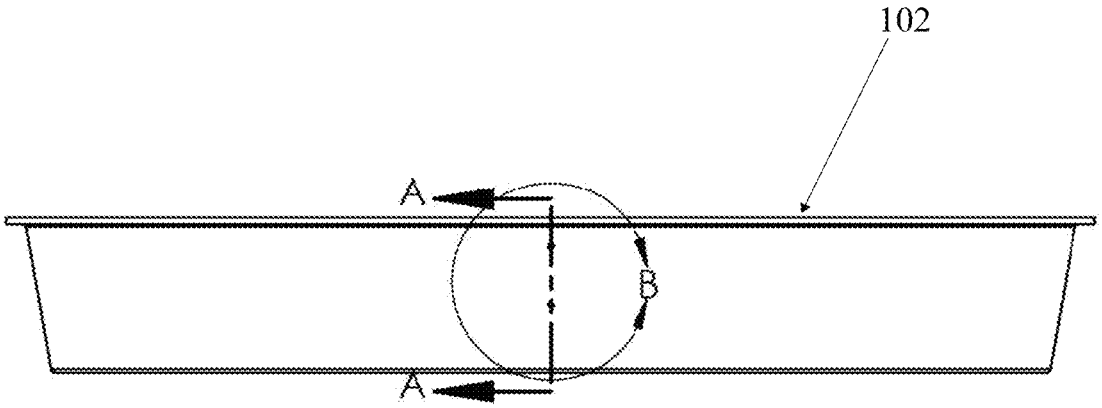
FIG. 27 is a side elevation view of the version of the ceiling fan adapter shown in FIG.
Figure 28:
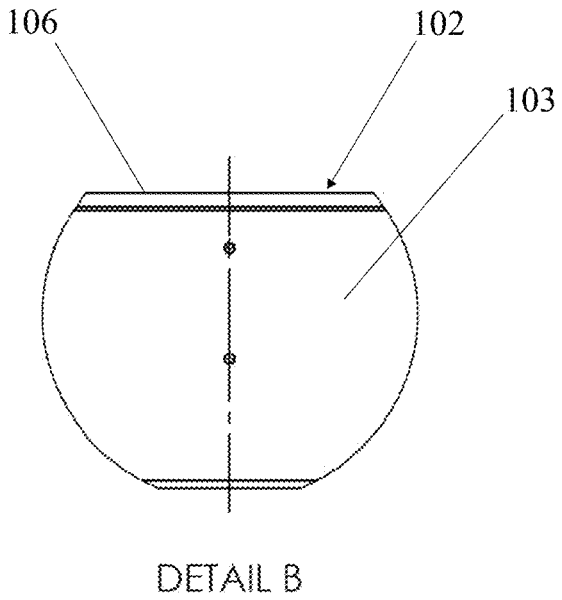
FIG. 28 is a detail view taken from detail B of FIG. 27.

In a version, as shown best in FIG. 22, each radial section 302 provides three radially outward extending tabs 308, a primary tab 308*c* centrally positioned along the upper perimeter 304*p* and a first and second reciprocal partial tabs 308*p* located at opposing ends of the upper perimeter 304. The first and second partial tabs 308*p* are configured to mate with an adjacent partial tab 308*p* of a second radial section 302 to form a complete tab 308 (See FIG. 20).

Figure 21:
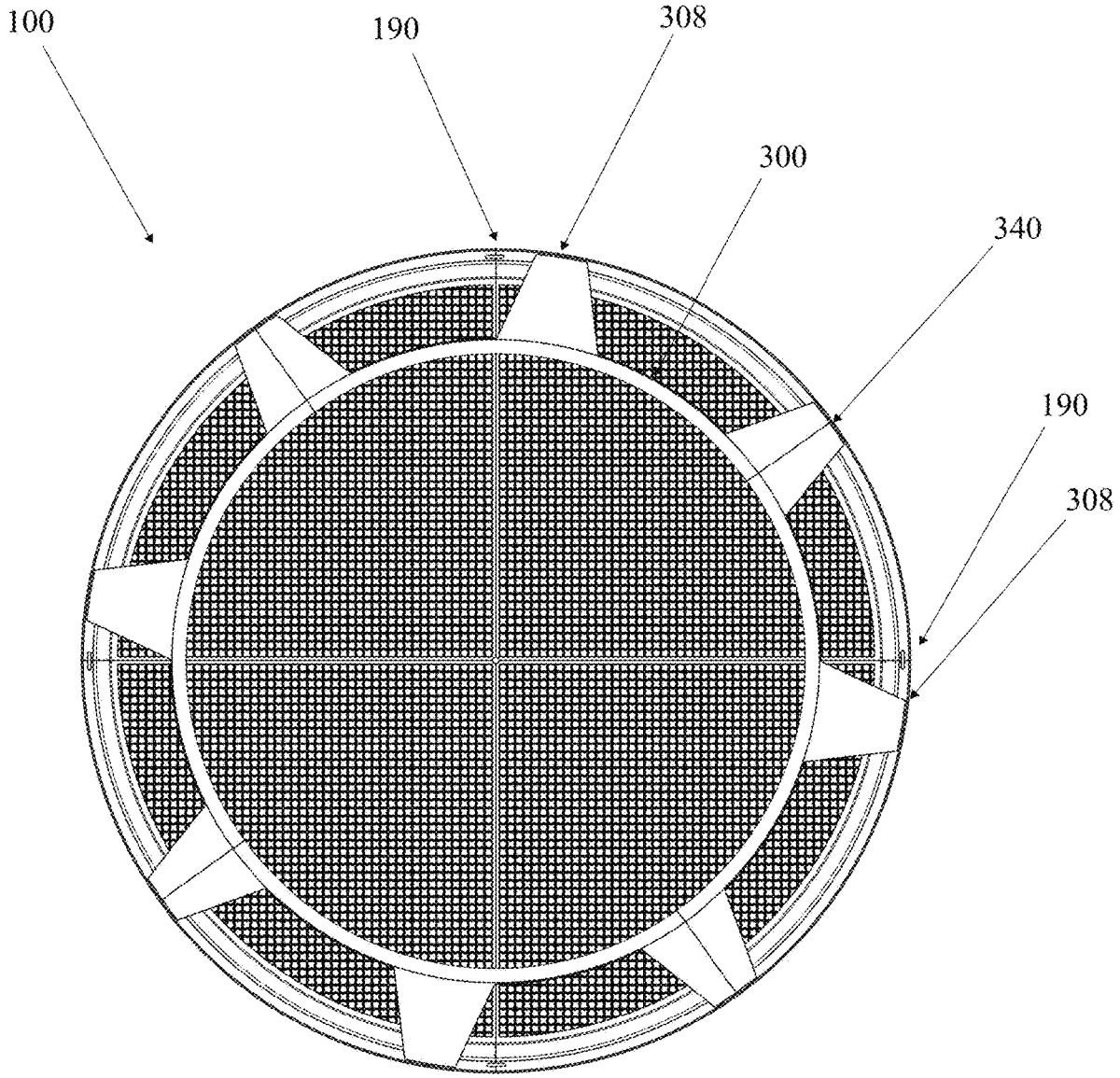
FIG. 21 is a top plan view of a version of the ceiling fan adapter having a radial spacer ring assembly.

FIG. 21 depicts an assembled version of the ceiling fan adapter assembly 100 that includes a radial spacer ring assembly 300. In the version, the attachment seams 340 and tabs 308 of the radial spacer ring assembly 300 are offset with respect to the attachment seams 190 of the ceiling fan adapter assembly 100 to provide superior strength in construction.

As best shown in FIG. 1, FIG. 36-FIG. 39, the mounting assembly 105 is operably configured to attach the shroud 102 to the fan down rod 208, providing support to the ceiling fan adapter assembly 100 (See FIG. 1). The mounting assembly generally attaches to the shroud 102 at a plurality of points about the upper perimeter 106. Preferably, the mounting assembly 105 comprises a down rod coupler 400 and a plurality of hang arms 402 that extend downward from the down rod coupler 400 at a 45 degree angle to the upper perimeter 106 of the shroud 102.

Figure 36:
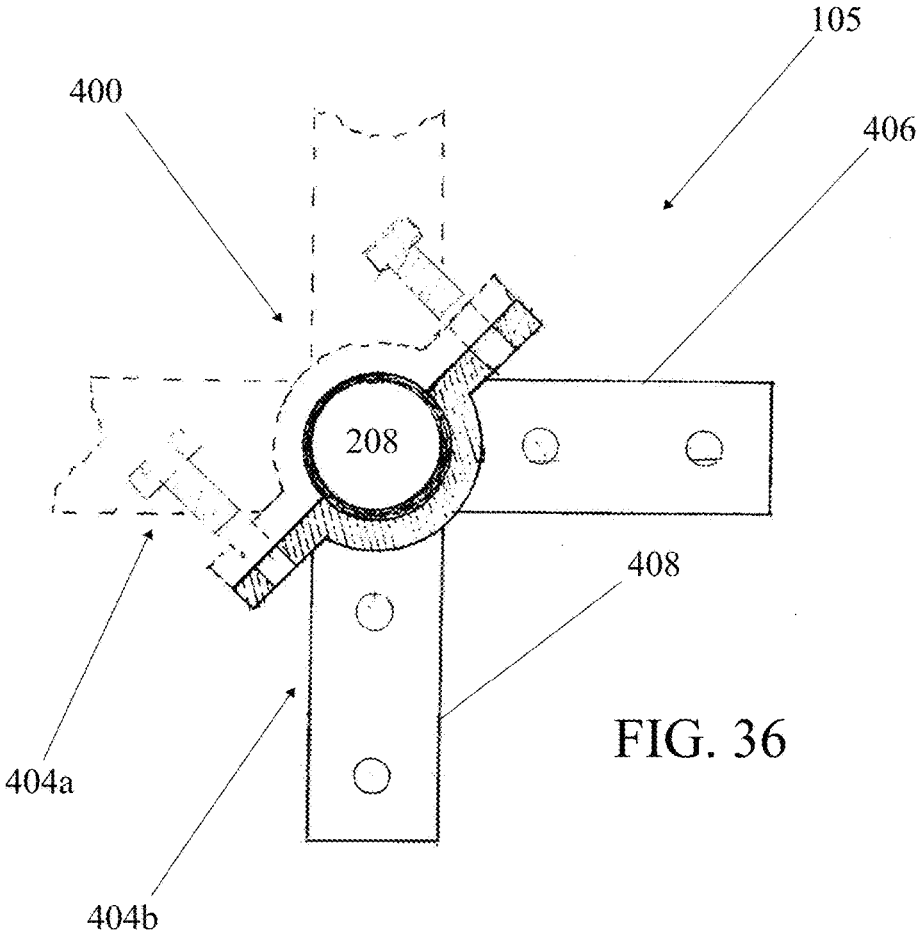
FIG. 36 is a top plan view of the down rod coupler of the mounting assembly.
Figure 37:
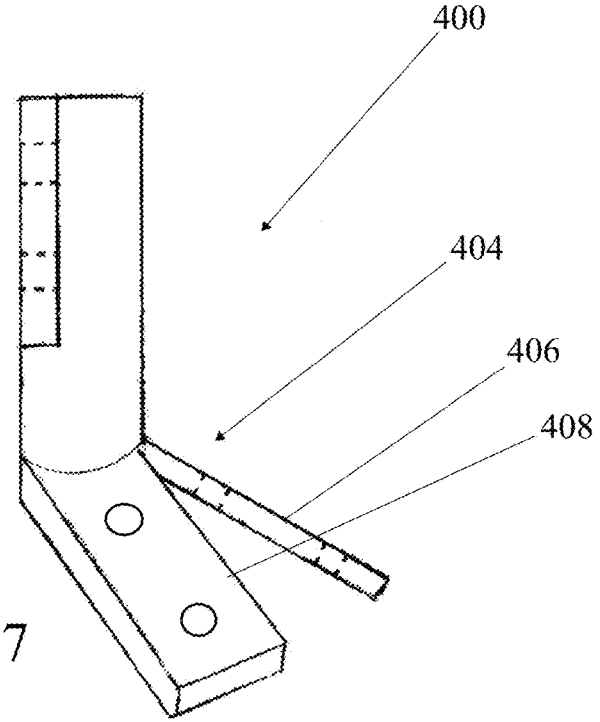
FIG. 37 is a side elevation view of the down rod coupler of the mounting assembly shown in FIG. 36.
Figure 38:
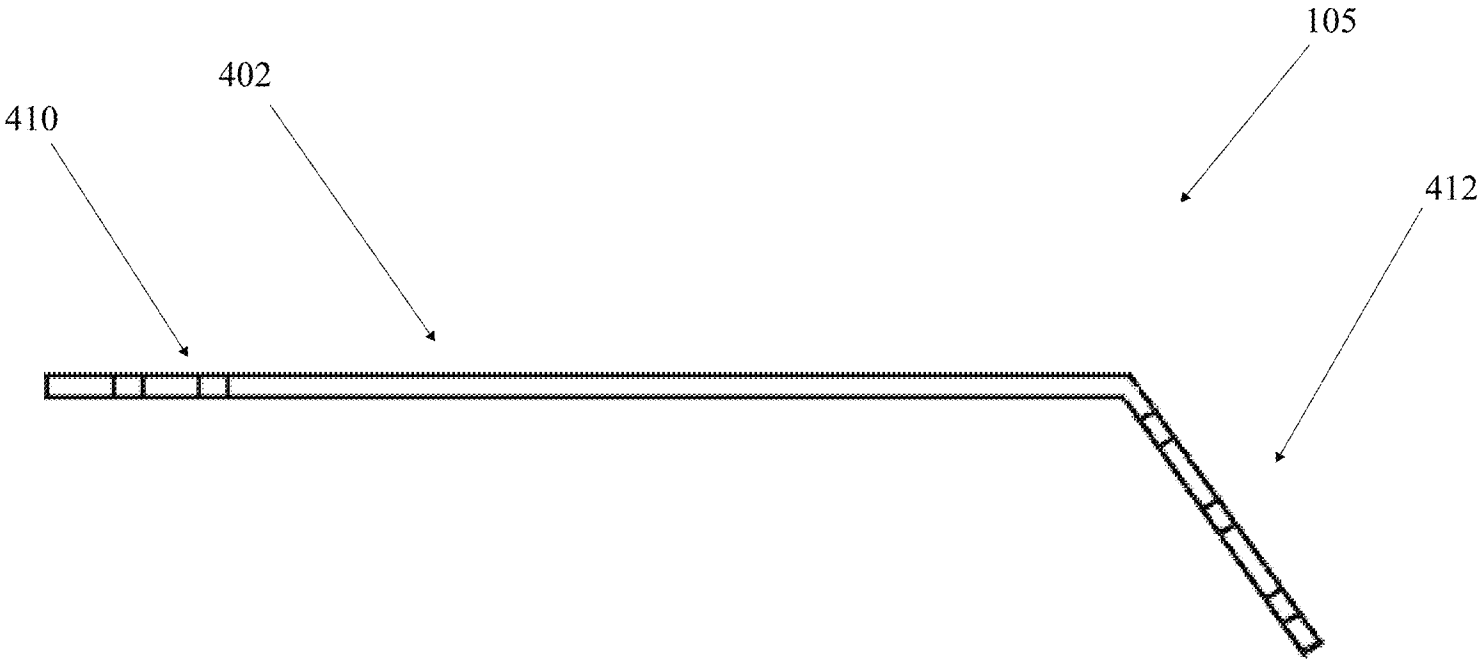
FIG. 38 is a side elevation view of the hang arm of the mounting assembly.
Figure 39:
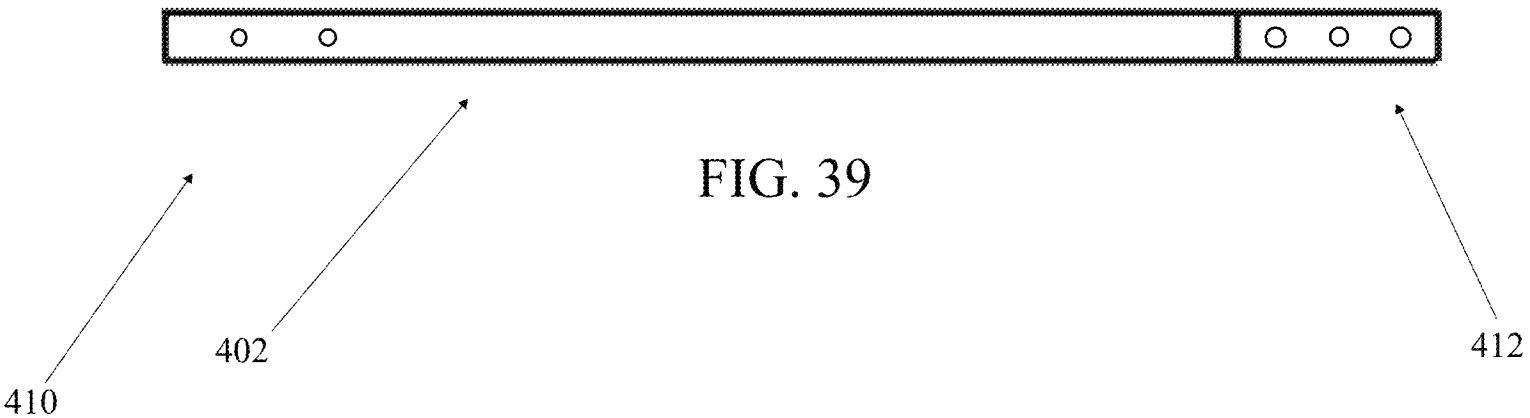
FIG. 39 is a top plan view of the hang arm of the mounting assembly shown in FIG. 38.

As shown best in FIG. 36 and FIG. 37, the down rod coupler 400 is comprised of two reciprocal connecting parts 404*a*, 404*b* that, when connected, sandwich the down rod 208. The connecting parts 404*a*, 404*b* each provide at least two downward extending connection platforms 406, 408 for support and connection of each respective hang arm 402. With reference to FIG. 38 and FIG. 39, the hang arm 402 comprises an upper end 410 that operably fastens to a respective connection platform 406, 408 and an angled lower end 412 that connects with the shroud 102, radial wall 103 (See FIG. 1).

In other embodiments, the ceiling fan adapter assembly 100 may further include a safety cable, preferably manufactured of steel. The safety cable attaches and secures to all major components of the ceiling fan adapter, including the shroud 102, the directing grid 104, and the radial spacer ring assembly 300 to an anchor point such as a ceiling joist.

The invention does not require that all the advantageous features and advantages be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification, including any claims, abstract, and drawings may be replaced by alternative features serving the same, equivalent or similar purpose unless expressly stated otherwise.

What is claimed is:

1. A ceiling fan adapter assembly for improving the flow of air in a space by a ceiling fan having a plurality of fan blades, the ceiling fan adapter assembly comprising:

a plurality of connecting equal radial sections, each radial section comprising:

a partial frustoconical shroud having an upper perimeter and a lower perimeter; and a directing grid attached to the partial frustoconical shroud at a lower end thereof, the directing grid comprising a plurality of intersecting members to reduce cross-sectional flow area, each of the plurality of intersecting members defines a narrowing rectangular cross-section from an upstream end to a downstream end and having at least two opposing walls.

2. The ceiling fan adapter assembly of claim 1, wherein the plurality of connecting equal radial sections are radial quarter-sections.

3. The ceiling fan adapter assembly of claim 1, further comprising at least one bracket vertically attached to a side of the partial frustoconical shroud.

4. The ceiling fan adapter assembly of claim 1, wherein the partial frustoconical shroud forms an outward angle with a plane defined by the directing grid between 75 degrees and 85 degrees.

5. The ceiling fan adapter assembly of claim 4, wherein the partial frustoconical shroud forms an outward angle with the plane of the directing grid between 79 degrees and 82 degrees.

6. The ceiling fan adapter assembly of claim 1, further comprising a frustoconical radial spacer ring assembly for attachment to at least one of the partial frustoconical shrouds, the frustoconical radial spacer ring assembly comprising:

a frustoconical radial wall; and a plurality of radially outward extending tabs configured to attach to the upper perimeter of at least one of the partial frustoconical shrouds.

7. The ceiling fan adapter assembly of claim 6, wherein the frustoconical radial spacer ring assembly is formed by a plurality of connecting equal radial sections.

8. The ceiling fan adapter assembly of claim 6, wherein the frustoconical radial wall forms an outward angle with a plane defined by the directing grid between 75 degrees and 85 degrees.

9. The assembly of claim 8, wherein the frustoconical radial wall forms an outward angle with the plane of the directing grid between 79 degrees and 82 degrees.

* * * * *